US006910576B2

(12) United States Patent
McGrath et al.

(10) Patent No.: US 6,910,576 B2
(45) Date of Patent: Jun. 28, 2005

(54) STORAGE DEVICE FOR STORING A COATING IMPLEMENT

(76) Inventors: John McGrath, 10 Ellet St., #102, Boston, MA (US) 02122; Thomas Payne, 34 Station St., #6, Brookline, MA (US) 02445

( * ) Notice: Subject to any disclaimer, the term of this patent is extended or adjusted under 35 U.S.C. 154(b) by 65 days.

(21) Appl. No.: 10/411,918

(22) Filed: Apr. 11, 2003

(65) Prior Publication Data

US 2004/0200747 A1 Oct. 14, 2004

(51) Int. Cl.[7] ..... B65D 83/10
(52) U.S. Cl. ..... 206/361; 206/15.3
(58) Field of Search ..... 206/361, 15.3, 206/209; 15/257.06; 220/4.22–4.25

(56) References Cited

U.S. PATENT DOCUMENTS 1,231,801 A * 7/1917 Smart et al. ..... 206/544
2,269,124 A * 1/1942 Ryan ..... 206/364
3,514,012 A * 5/1970 Martin ..... 220/570
3,623,179 A * 11/1971 Roth ..... 15/104.001
4,467,533 A * 8/1984 Sica ..... 34/58
5,074,098 A 12/1991 Filipchuk
5,178,274 A 1/1993 Long
5,353,934 A * 10/1994 Yamauchi ..... 206/454
5,540,363 A 7/1996 Wilson
5,709,301 A 1/1998 Couch et al.
5,797,410 A * 8/1998 Gates ..... 134/138
5,829,603 A 11/1998 Martineau
5,966,902 A 10/1999 Korycki
6,050,408 A 4/2000 Testa
6,193,080 B1 2/2001 Castillo
6,338,406 B1 1/2002 Zagar
6,390,430 B1 5/2002 Hawley et al.
6,530,470 B2 * 3/2003 Roundy ..... 206/15.3
2003/0188980 A1 * 10/2003 Myers ..... 206/361

* cited by examiner

*Primary Examiner*—Byron P. Gehman
(74) *Attorney, Agent, or Firm*—Fish & Richardson P.C.

(57) ABSTRACT

A storage device for storing a roller includes an upper member and a lower member that is pivotally connected along an edge of the upper member, the upper and lower members defining therebetween an enclosed cavity with the storage device in a closed position. The upper and lower members together define an opening, in the closed position, that extends into the enclosed cavity, the opening being sized to accommodate a handle of the roller with a nap of the roller disposed within the enclosed cavity. Each of the upper and lower members have at least one corresponding projection that extends into the enclosed cavity a predetermined distance to engage the roller and to prevent contact between the nap and the upper and lower members.

36 Claims, 5 Drawing Sheets

STORAGE DEVICE FOR STORING A COATING IMPLEMENT

TECHNICAL FIELD

This invention relates to storage devices, and more particularly to devices adapted for holding and storing wet rollers.

BACKGROUND

Rollers are used for a variety of applications, such as, for example, painting. These rollers come in a variety of shapes and sizes. Typically, the rollers include a nap that can be impregnated and/or coated with a coating material (e.g., paint, shellac, or the like) and then used to coat a surface with the material.

Frequently, during the coating process, the roller must be transported from one place to another. During transportation, there is potential for inadvertent contact of the impregnated nap with nearby surfaces. Additionally, the coating process may be interrupted, thus requiring storage of the roller for later use. Often times, the roller including nap is simply placed on a surface and exposed to the open air. In this situation, foreign particles such as dirt or dried material can become attached to a surface of the nap. Further, liquid material on the nap may dry or cure, to some extent. To remedy at least some of these effects, it may be necessary to clean the roller including nap before storage. However, this process is time-consuming and requires use of water and/or cleaning material, such as paint thinner, for example. Also, placing the nap on a surface, even temporarily, can result in a misshapen nap making it more difficult to apply an even coat of material.

SUMMARY

In an aspect, the invention features a storage device for storing a roller having a handle and a nap. The storage device has an upper member that is pivotally connected to a lower member. The upper and lower members form an enclosed cavity with the storage device in a closed position. Together, the upper and lower members have an opening that extends into the enclosed cavity. The opening accommodates the handle of the roller with the nap of the roller disposed within the enclosed cavity. To position the roller within the cavity, each of the upper and lower members have at least one corresponding projection extending into the enclosed cavity a predetermined distance to engage the roller and to reduce contact between the nap and the upper and lower members.

In another aspect, the invention features a storage device for storing a coating implement having a handle and a coating surface. The storage device has an upper member that is pivotally connected to a lower member. The upper and lower members form an enclosed cavity with the storage device in a closed position. The upper and lower members together have an opening that extends into the enclosed cavity. The opening accommodates the handle of the coating implement with the coating surface of the implement disposed within the enclosed cavity. To position the coating implement within the cavity, each of the upper and lower members have at least one corresponding projection extending into the enclosed cavity a predetermined distance to engage the coating implement and to reduce contact between the coating surface and the upper and lower members.

Implementations of the above aspects may include one or more of the following features. For example, a hinge may connect the upper and lower members.

In some embodiments, the storage device may have a seal positioned between the upper and lower members with the storage device in the closed position.

In some embodiments, an insert may be removably positioned within the opening when the storage device is in the closed position. To aid in removing the insert, embodiments may include a handle, such as a filament or yarn that is attached to the insert.

In another aspect, the invention features a storage device for storing a roller having a nap and a handle. The handle portion of the roller has a transverse section. The storage device includes an upper member and a lower member pivotally connected by a hinge to the upper member. The upper and lower members form an enclosed cavity with the storage device in a closed position. An arcuate opening extends into the enclosed cavity to accommodate the transverse section of the handle of the roller with the nap of the roller disposed within the enclosed cavity. Each of the upper and lower members have an array of projections extending into the enclosed cavity a predetermined distance to engage the nap and to reduce contact between the nap and the upper and lower members. A seal is positioned between the upper and lower members with the storage device in the closed position by affixing the seal to a ledge of one of the upper or lower members. Removably positioned within the opening with the storage device in the closed position is an insert.

Implementations of any of the above aspects may include one or more of the following features. For example, the upper and lower members may include recesses for slidably inserting and positioning the projections and the projections may be removed from the recesses. In some embodiments, the hinge may be a living hinge or the hinge may include at least two components.

In some cases, caps may be used to cover distal ends of the projections and the caps may be removable. The caps may be employed to provide a barrier between the projection and liquid material.

In some embodiments, the seal may provide an airtight enclosure. To secure the storage device in the closed position, some embodiments may include a latch and the latch may include a lock. The lock can prevent unauthorized opening of the storage device by, for example, a child or infant.

In some embodiments, the upper member may include a handle and/or a clip to aid in transporting the storage device. A stand, including legs, may be used, in some embodiments, for supporting the storage device in an upright position when placed on a surface.

In some cases, a removable liner lines an inner surface of at least one of the upper and lower members. The liner may also form the projections. In some cases, the liner forms the caps.

In some cases, the upper and lower members may each be integrally molded. In some embodiments, the enclosure formed by the upper and lower members when closed may be arcuate or box-like in shape. In some cases, the opening, through which a handle can extend, may also be arcuate.

In some embodiments, the lower member may include at least six projections. Where six projections are used, they may be arranged in a 3×2 array. In some embodiments, the upper member may include at least three projections. Where three projections are used, they may be aligned in a row. In some cases, the projections extend to different lengths. In some embodiments, the projections extend to substantially the same length.

In some embodiments, the projections are sized to penetrate a surface of the nap. In some cases, the projections contact a core of the nap.

Embodiments of the invention may have one or more of the following advantages. The storage device is configured to store a coating surface, for example, a nap that is coated and/or impregnated with a liquid coating material, such as paint, while reducing curing of the liquid material when the nap is stored therein. This reduction can be increased by employing seals.

Manufacture of the storage device can take advantage of standardization of roller and/or nap sizes. The storage device can also be manufactured for custom purposes. Additionally, the storage device can be designed to store various roller and/or nap sizes.

The projections position the, e.g., nap spaced-apart from inner surfaces of the storage device to reduce coating the inner surfaces with liquid material, which, in turn, reduces the amount of cleaning needed to maintain the storage device. Because the projections extend from both upper and lower members, the nap is stored relatively securely within the storage device.

The projections provide a support structure for supporting the coating surface within the storage device. This support structure provided by the projections reduces area of contact between the coating surface and the support structure while the coating surface is positioned within the storage device. Due to this reduction in contact area, any deformation or misshapenness of the coating surface due to storage can be reduced.

In some cases, the projections penetrate a surface of the nap and support the nap within the device. In these cases, position and lay of fibers of the nap will have similar consistency of its last application of paint or other liquid substance.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
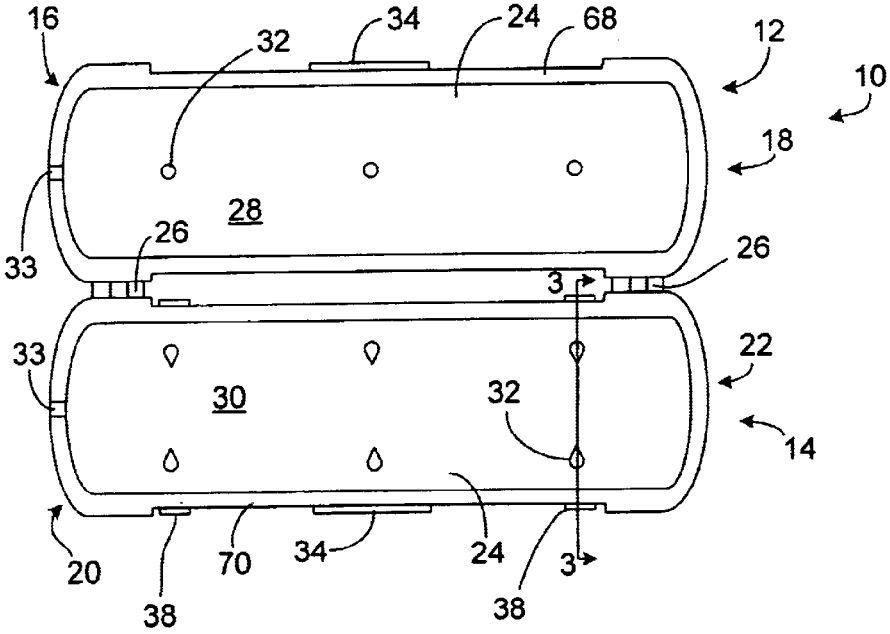
FIG. 1 is a top view of a storage device in an open position.

Referring to FIGS. 1–3A, a storage device for storing a roller is illustrated. Referring particularly to FIG. 1, a storage device 10 is shown in an open position and is particularly suited for storing a roller that includes a nap. The storage device includes an upper member 12 and a lower member 14. Each of the upper and lower members has a pair of ends (elements 16 and 18 refer to the ends of the upper member and elements 20 and 22 refer to the ends of the lower member) and a pair of sides. The ends and sides can be arcuate, squared, or any shape suitable for forming an enclosure. Extending between the ends and sides of each of the upper and lower members are surfaces 28 and 30, respectively. As shown, surfaces 28 and 30 are arcuate in shape, however, the surfaces can be formed as any suitable shape including, for example, substantially planar, or a combination of shapes. Each of the upper 12 and lower 14 members is sized to at least partially extend about the nap of the roller.

Referring still to FIG. 1, the ends and sides define a ledge that extends about the periphery of the upper and lower members. Ledges 68 and 70 form adjacent surfaces when the storage device is closed (see FIG. 2). The storage device can include a seal 81 that is attached to ledges 68 and 70 (see FIGS. 3A and 3B). The seal 81 can be extended around the periphery of at least one of the upper and lower members for minimizing seepage of air and moisture from the storage device with the storage device in the closed position.

Figure 6:
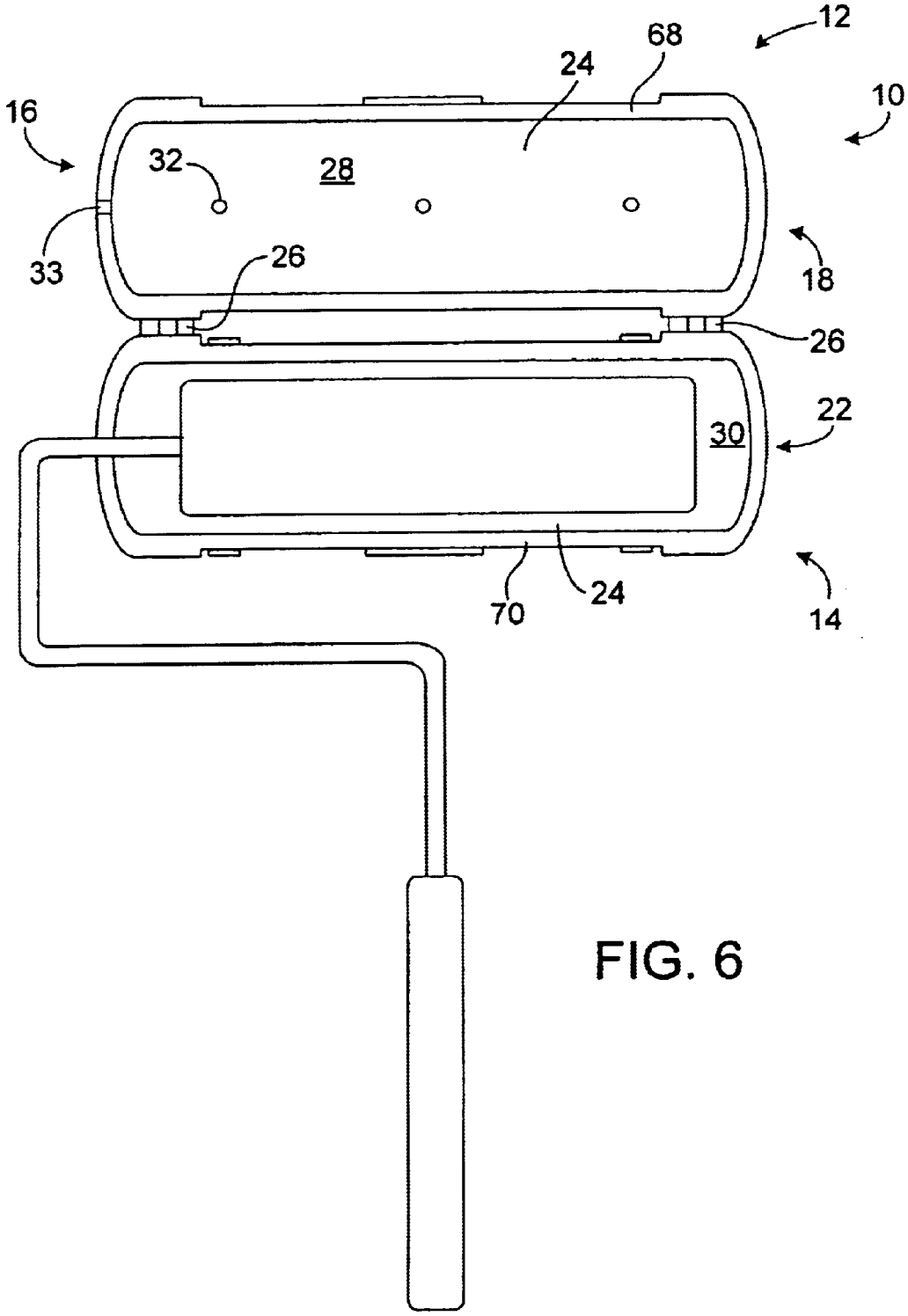
FIG. 6 shows the storage device of FIG. 1 containing a paint roller.

Upper member 12 and lower member 14 are connected by an attachment 26, such as a hinge, including a living hinge, as an example. The attachment can have one or more components. The attachment 26 allows for rotational movement of the upper and lower members relative to each other. As a result, the upper and lower members can rotate between open and closed positions (see FIG. 2). In the open position, the storage device 10 is capable of receiving the roller and/or nap of the roller (see FIG. 6, illustrating a roller positioned with a storage device). In the closed position, the upper member 12 and the lower member 14 extend about the roller and/or nap forming a relative enclosure.

Extending from inner surfaces 28 and 30 of each of the upper and lower members are tines or projections 32. Projections 32 extend outwardly to a distal end and are placed in predetermined positions along inner surfaces 28 and 30. The projections 32 serve to position the nap within the storage device and spaced-apart from the inner surfaces 28 and 30. Various numbers of projections can be used, for example, from 1 to 20, and in various configurations, such as staggered, rows, columns, or the like. Preferably the storage device has six projections extending from the inner surface of the lower member. The six projections are aligned in rows and columns forming a 3×2 array. The upper member 12 includes an array of three projections extending from its inner surface forming a row. Importantly, each projection is of a height to allow the upper and lower members to extend around the nap to the closed position and to position the nap spaced apart from the inner surface of the upper and lower members. Also, although projections 32 extend to the substantially the same length, the projections can extend to differing lengths.

At ends 16 and 20 of the upper and lower members are recesses 33. The recesses 33 are positioned to correspond with each other to form an opening 35 (see FIG. 2A) when the upper member 12 and lower member 14 are in the closed position. The size of the recesses 33 can vary but they are sized to extend around the handle of the roller allowing the upper and lower members to close and extend about the roller and/or nap of the roller. In other words, the handle of the roller can extend out of the enclosure formed by the upper and lower members. Additionally, the seal 81 can be positioned within the recesses to form a seal around the handle positioned therein with the storage device closed. Alternatively a second seal (not shown) may be placed within the recesses or at least one recess.

Figure 2:
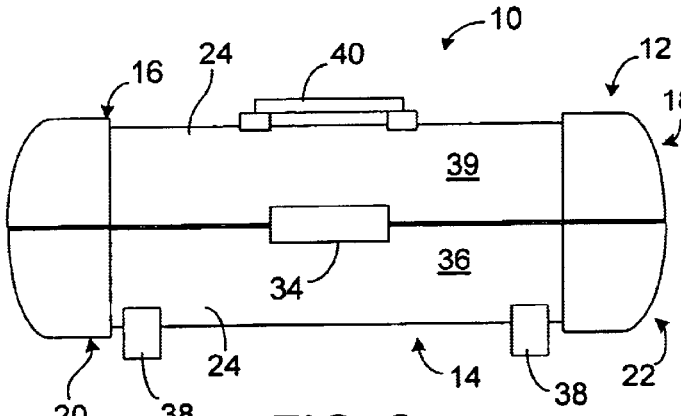
FIG. 2 is a front view of the storage device in a closed position.
Figure 2A:
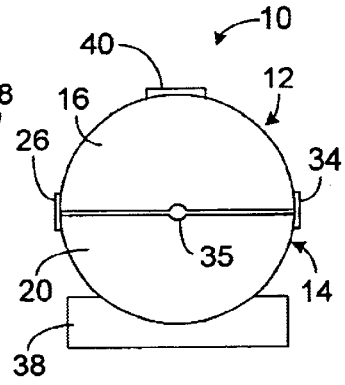
FIG. 2A is a side view of the storage device of FIG. 2.

Referring also to FIGS. 2 and 2A, the storage device 10 can include a latch 34 for securing the storage device in the closed position. The latch 34 can be used when the device is in the closed position regardless of whether the nap is contained therein. The latch can be any number of devices including snaps, buckles, detents, etc. More than one latch can also be used. Also the latch can include securing straps, such as straps having pressure sensitive adhesive. Additionally, in some embodiments, the latch can include a lock for preventing an unauthorized opening of the storage device by, for example, a child or infant.

Extending from an outer surface 36 of the lower member 14 are legs 38. Legs 38 provide a stable support structure when the storage device is placed on a surface. Also, on an outer surface 39 of the upper member 12, a handle 40 is affixed. However, the storage device may not include legs or a handle. The storage device can also include other carrying devices such as a clip or the handle may be a molded with the storage device.

The storage device can be sized to accommodate a variety of nap sizes, for example, from a nap of less than about 3 inches in length, to a nap greater than 21 inches in length, including nap sizes of about 3, 7, 9, 18, 20 and 21 inches. The storage device can similarly be sized to accommodate naps of various diameters, for example, from less than about ¼ inch to greater than about 1¾ inches.

The projections can also be positioned to take advantage of standardization within the roller industry. For example, projections 32 can be positioned within the storage device to support naps/rollers of various lengths and sizes. This can be accomplished by, for example, providing a relatively dense projection arrangement. By providing a relatively dense projection arrangement, naps of various sizes can be positioned within the storage device.

Preferably, the upper and lower members including the ends, sides, projections, etc. are integrally molded. However, the ends, sides, or other components can be individually bonded, by adhesive and/or mechanical devices such as screws, nails etc. A variety of materials can be employed to form the storage device including polymers such as poly vinyl chloride, polyethylene, or the like. The molding material can be selected to form a disposable storage device or the materials can be selected to form a reusable storage device that is sufficiently durable for repeated use.

Figure 3B:
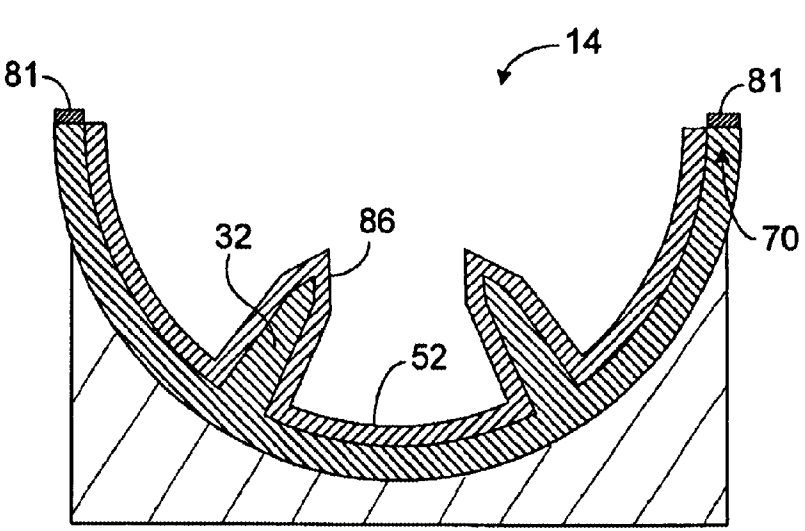
FIG. 3B is a cross-sectional view taken along line 3—3 of FIG. 1, of a second embodiment.
Figure 3A:
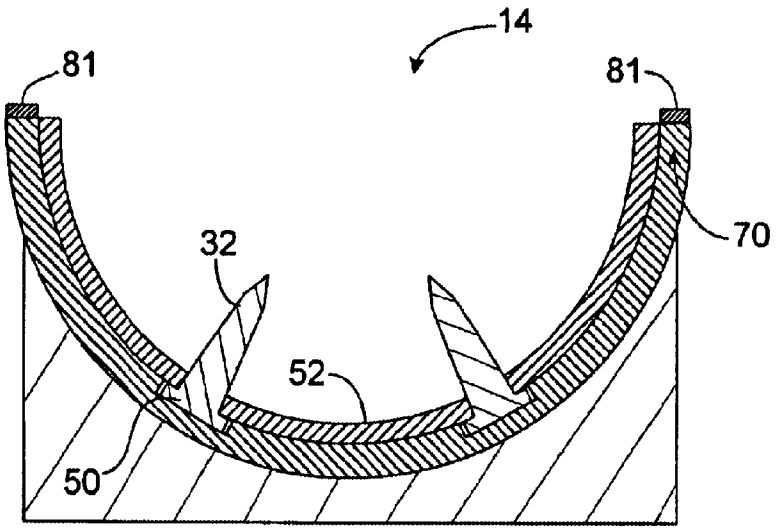
FIG. 3A is a cross-sectional view taken along line 3—3 of FIG. 1, of a first embodiment.

Referring now to FIGS. 3A and 3B, a cross-sectional view of the storage device of FIGS. 1–2A, is shown. Referring particularly to the embodiment of FIG. 3A, the lower member 14 includes cavities 50 sized to receive the projections 32. The cavities 50 position the projections 32 within the storage device and allow the projections to be removed from the cavities. Adjacent to the inner surface of the lower member is a liner 52 that is sized to be positioned within the storage device. The liner 52 is positioned adjacent to the inner surface and can cover the inner surface to minimize deposition of liquid material on the inner surface. The liner can be removed from the lower member or the storage device can be used without the liner and/or projections. To allow the projections to extend through the liner, the liner defines holes (not shown). As an alterative, the liner can be formed to include projections 32.

Positioned on ledge 70 is the seal 81. The seal can be made of any number of materials including, for example, foams, silicone, or the like that can be bonded to at least one of the ledges 68, 70 of the upper and lower members. An adhesive can be used to bond the seal to ledges, if necessary. The seal can also be manufactured as, for example, an O-ring and then affixed to the ledge.

Referring now to FIG. 3B, the projections 32 are integrally molded to and project from the liner surface of the lower member. It should be noted, that while the projections are integrally molded, they can also be bonded to the inner surface using, for example, an adhesive, or, alternatively, the projections can be bonded within cavities, such as those illustrated by FIG. 3A. Extending about the projections 32 are caps 86. The caps 86 can be removed from the lower member for cleaning and to protect a surface of the projections from the liquid material. As in FIG. 3A, a liner 52 defining holes is positioned adjacent to the inner surface of the lower member to protect the surface from deposition of the liquid material. Alternatively, caps 86 can be formed by liner 52, such as by molding extensions into the lining that are sized to be positioned about projections 32.

Figure 4:
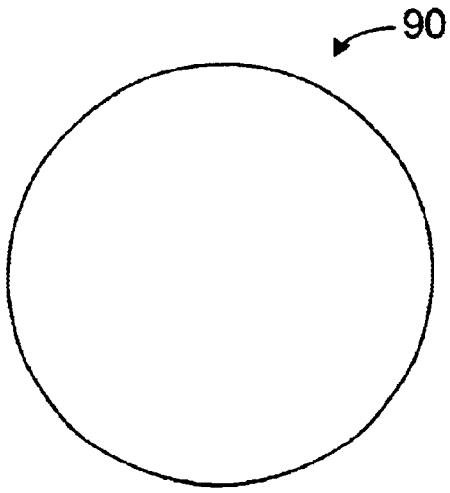
FIGS. 4 and 4A are front and side views, respectively, of a first insert.
Figure 4A:
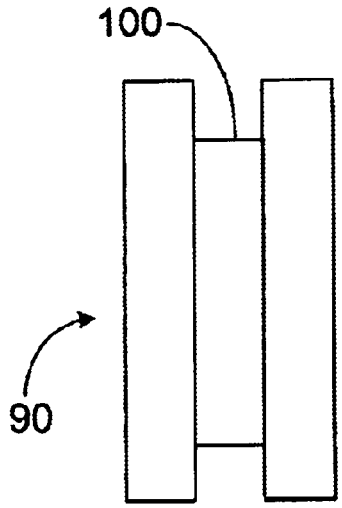
Figure 5:
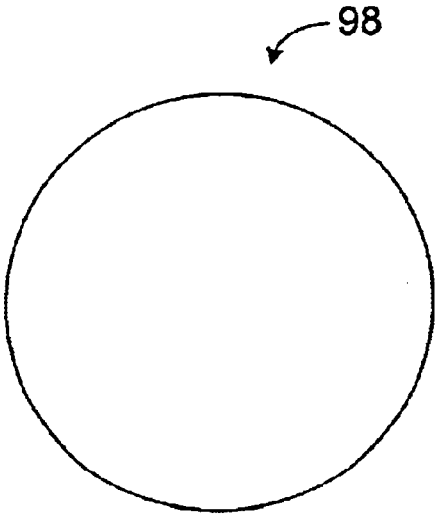
FIGS. 5 and 5A are front and side views, respectively, of a second insert.
Figure 5A:
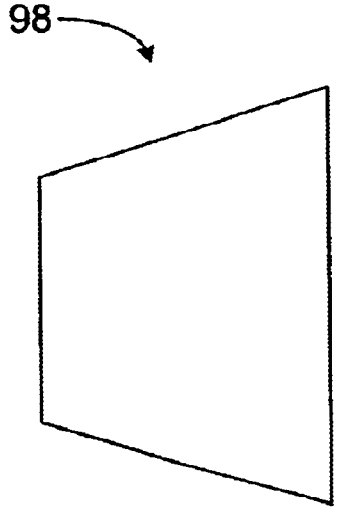

Embodiments can be used to store a nap without the roller. Therefore, to minimize the potential for curing of liquid material on the nap stored within the storage device, a second seal or insert can be employed to be positioned within the opening defined by the recesses. Referring to FIGS. 4–5A, seal embodiments 90 and 98 are illustrated. The seals 90 and 98 are sized to be positioned within the opening to form a seal to minimize the seepage of air and moisture. Inserts can include a U-shaped groove 100 that is sized to receive a ledge of the recesses or the inserts may not include a ledge. The seal can further include a handle, such as an attached yarn, to aid in removing and positioning of the second seal. In FIG. 5, the seal 98 is cork-shaped. The seal can be made of any number of suitable materials such as polymers, rubber, or the like, as examples.

Figure 7:
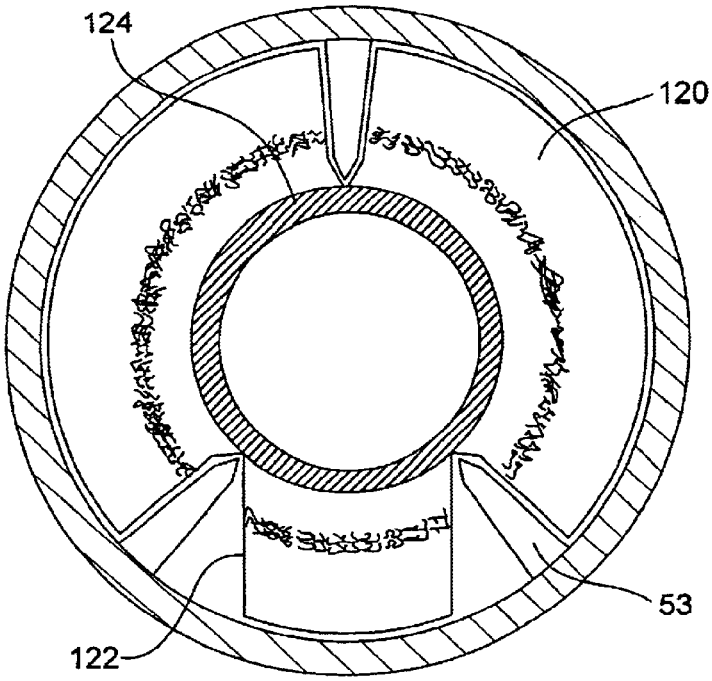
FIG. 7 is a sectional side view of a storage device.

A number of embodiments of the invention have been described. Nevertheless, it will be understood that various modifications may be made without departing from the spirit and scope of the invention. For example, referring to FIG. 7, a storage device is shown having tires 53 that are sized to penetrate an outer surface of the nap 120. In some cases, the tires 53 extend through the nap and contact a core 124 of the nap, stabilizing the nap in a position spaced-apart from surfaces of the storage device. Importantly, the tires 53 can be sized to reduce displacement of nap fibers 122. By sizing the tires 53 to penetrate the surface of the nap 120, the ends of the tires 53 can rest adjacent the core 124 of the nap 120 thus reducing pressure against the surface of the nap 120, which can result in a misshapen nap. In some cases, the tires 53 penetrate the surface of the nap, storing the nap within the storage device without contacting the core 124. As another example, upper and lower members can be a variety of shapes to hold a variety of rollers of different shapes and sizes. Accordingly, other embodiments are within the scope of the following claims.

What is claimed is:

1. A storage device for storing a roller having a handle and a nap, the storage device comprising:

an upper member;

a lower member pivotally connected to the upper member, the upper and lower members defining therebetween an enclosed cavity with the storage device in a closed position;

the upper and lower members together defining an opening extending into the enclosed cavity and sized to accommodate the handle of the roller with the nap of the roller disposed within the enclosed cavity; and each of the upper and lower members having at least one corresponding tine sized to penetrate a surface of the nap, the tines of the upper and lower members extending into the enclosed cavity a predetermined distance to engage opposite sides of the roller and to reduce contact between the nap and the upper and lower members.

2. The storage device of claim 1 further comprising a first seal positioned between the upper and lower members with the storage device in the closed position.

3. The storage device of claim 1, wherein inner surfaces of the upper and lower members define recesses for slidably inserting and positioning the tines, the tines being removable from the recesses.

4. The storage device of claim 1 further comprising removable caps sized to cover distal ends of the tines.

5. The storage device of claim 1 further comprising a latch arranged to secure the storage device in the closed position.

6. The storage device of claim 5, wherein the latch includes a lock.

7. The storage device of claim 1 wherein the upper member further includes a handle attached to an outer surface of the upper member.

8. The storage device of claim 1 wherein the upper and lower members are connected by a hinge.

9. The storage device of claim 1, wherein the lower member further includes a stand extending from an outer surface of the lower member for supporting the storage device in an upright position when placed on a surface.

10. The storage device of claim 9, wherein the stand comprises a pair of legs.

11. The storage device of claim 1, wherein the storage device further comprises a removable liner that lines an inner surface of at least one of the upper and lower members.

12. The storage device of claim 11, wherein the liner defines the projections.

13. The storage device of claim 11, wherein the liner defines caps that are sized to extend about the projections.

14. The storage device of claim 1 further comprising an insert sized to be removably positioned within the opening when the storage device is in the closed position.

15. The storage device of claim 14, wherein the insert further includes a filament attached to the insert.

16. The storage device of claim 1, wherein the upper and lower members are each integrally molded.

17. The storage device of claim 1 further comprising a clip affixed to an outer surface of the upper member.

18. The storage device of claim 1, wherein the enclosed cavity is arcuate in shape.

19. The storage device of claim 1, wherein the enclosed cavity is box-shaped.

20. The storage device of claim 1, wherein the opening is arcuate in shape.

21. The storage device of claim 1, wherein the lower member includes at least six tines.

22. The storage device of claim 21, wherein the lower member includes six tines, the tines arranged in a 3×2 array.

23. The storage device of claim 1, wherein the upper member includes at least three tines.

24. The storage device of claim 23, wherein the upper member includes three tines aligned in a row.

25. The storage device of claim 1, wherein the tines penetrate the surface of the nap and contact a core of the nap.

26. The storage device of claim 1, wherein the tines extend to different lengths.

27. The storage device of claim 1, wherein the tines extend to substantially the same length.

28. A storage device for storing a roller having a nap and a handle, the handle including a transverse section, the storage device comprising:

an upper member;

a lower member pivotally connected by a hinge to the upper member, the upper and lower members defining therebetween an enclosed cavity with the storage device in a closed position;

the upper and lower members together defining an arcuate opening extending into the enclosed cavity and sized to accommodate the transverse section of the handle of the roller with the nap of the roller disposed within the enclosed cavity;

each of the upper and lower members having an array of tines sized to penetrate a surface of the nap, the tines of the upper and lower members extending into the enclosed cavity a predetermined distance to engage opposite sides of the nap and to reduce contact between the nap and the upper and lower members;

a seal positioned between the upper and lower members with the storage device in the closed position, the seal being affixed to a ledge defined by one of the upper or lower members; and an insert sized to be removably positioned within the opening with the storage device in the closed position.

29. A storage device for storing a roller having a handle and a nap, the storage device comprising:

an upper member;

a lower member pivotally connected to the upper member, the upper and lower members defining therebetween an enclosed cavity with the storage device in a closed position;

the upper and lower members together defining an opening extending into the enclosed cavity and sized to accommodate the handle of the roller with the nap of the roller disposed within the enclosed cavity;

each of the upper and lower members having at least one corresponding projection extending into the enclosed cavity a predetermined distance to engage the roller and to reduce contact between the nap and the upper and lower members; and one of the upper and lower members having a removable liner that defines its at least one projection.

30. The storage device of claim 29, wherein the lower member includes six projections arranged in a 3×2 array.

31. The storage device of claim 30, wherein the upper member includes at least three projections aligned in a row.

32. The storage device of claim 31, wherein the projections penetrate the surface of the nap and contact a core of the nap.

33. A storage device, for storing a roller having a handle and a nap, the storage device comprising:

an upper member;

a lower member pivotally connected to the upper member, the upper and lower members defining therebetween an enclosed cavity with the storage device in a closed position;

the upper and lower members together defining an opening extending into the enclosed cavity and sized to accommodate the handle of the roller with the nap of the roller disposed within the enclosed cavity;

each of the upper and lower members having at least one corresponding projection extending into the enclosed cavity a predetermined distance to engage the roller and to reduce contact between the nap and the upper and lower members; and a removable liner that lines an inner surface of at least one of the upper and lower members wherein the liner defines caps that are sized to extend about the at least one projection.

34. The storage device of claim 33, wherein the lower member includes six projections arranged in a 3×2 array.

35. The storage device of claim 34, wherein the upper member includes at least three projections aligned in a row.

36. The storage device of claim 35, wherein the projections penetrate the surface of the nap and contact a core of the nap.

* * * * *